US006775849B1

(12) United States Patent
Messman

(10) Patent No.: US 6,775,849 B1
(45) Date of Patent: Aug. 17, 2004

(54) WRINKLED-TAB-AND-CONNECTOR METHOD FOR RELEASABLY BINDING PAIRED ARTICLES TOGETHER

(76) Inventor: Robert Messman, 600 S. Monroe Way, Denver, CO (US) 80209

( * ) Notice: Subject to any disclaimer, the term of this patent is extended or adjusted under 35 U.S.C. 154(b) by 0 days.

(21) Appl. No.: 10/463,027

(22) Filed: Jun. 16, 2003

Related U.S. Application Data

(60) Provisional application No. 60/388,872, filed on Jun. 17, 2002.

(51) Int. Cl.[7] ..... A41D 27/08
(52) U.S. Cl. ..... 2/239
(58) Field of Search ..... 2/239, 240, 241, 2/242, 409, 160, 321, 312; 24/DIG. 29, 30.5 P, 16 PB, 904

(56) References Cited

U.S. PATENT DOCUMENTS 2,779,076 A * 1/1957 Schenck, Sr. ..... 24/531
2,785,413 A * 3/1957 Cook ..... 2/240
3,601,818 A * 8/1971 Chesebro et al. ..... 2/239
4,351,067 A * 9/1982 Bartels ..... 2/160
5,009,516 A * 4/1991 Geeck ..... 383/37
5,038,413 A * 8/1991 Ursino ..... 2/239
5,189,761 A * 3/1993 Chisholm ..... 24/16 PB
5,579,541 A * 12/1996 Christy et al. ..... 2/239
5,740,558 A * 4/1998 Messman ..... 2/239
5,920,968 A * 7/1999 Anscher ..... 24/598.2
5,970,524 A * 10/1999 Becker et al. ..... 2/239
6,062,622 A * 5/2000 Susman et al. ..... 294/149
6,161,263 A * 12/2000 Anderson ..... 24/545
6,216,279 B1 * 4/2001 Ellingson ..... 2/239
6,247,183 B1 * 6/2001 Haas-Laursen ..... 2/239

* cited by examiner

*Primary Examiner*—John J. Calvert
*Assistant Examiner*—Alissa L. Hoey
(74) *Attorney, Agent, or Firm*—Ramon L. Pizarro; Edwin H. Crabtree

(57) ABSTRACT

A system for releasably binding or joining paired articles together. The invention consists of short strips, coated with a film adhesive on one side, adhesively-bonded at both ends to the top (or entry) outside edge of paired cloth items to form a loop on each item. An elongated connector with a male end and a female end is provided to join the two articles together. The first item is attached to the second item by passing the elongated, generally flat connector through the loop formed on the first item and the loop formed on the second item and then inserting a male end through a female end to lock the re-useable elongated generally flat connector through the first loop and the second loop.

18 Claims, 4 Drawing Sheets

WRINKLED-TAB-AND-CONNECTOR METHOD FOR RELEASABLY BINDING PAIRED ARTICLES TOGETHER

REFERENCE TO RELATED APPLICATIONS

This application is a continuation of, and claims the benefit of, my provisional application having Ser. No. 60/388,872, filed Jun. 17, 2002, now abandoned.

BACKGROUND OF THE INVENTION 1. (a) Field of the Invention

This invention generally relates to a mechanism for releasably binding paired articles together. The invention includes short fabric tabs used to create looped sections on each sock, and a connector that extends through the loops to join the articles.

2. (b) Discussion of Known Art

My U.S. Pat. No. 5,740,558 teaches a method for connecting items such as socks together. However, discussions with sock manufacturers indicate the following criteria are key to developing an attachment system attractive to both manufacturers and consumers of paired items of apparel like socks:

1) Costs need to be minimized for any linking processes due to generally low margins on mated products.

2) Linking devices or systems need to be arranged to avoid skin contact and not create stiff uncomfortable areas on worn clothing. The linking system should be attached to the outside of a wearable item near the opening end in a manner that minimally impedes the stretchability of the top cuff of socks, gloves, etc.

3) A linking system should use a connecting process, which allows any pair of socks or other paired items to be bound together. This allows the industry to avoid the problem of left and right sock pairs, which would greatly complicate the pairing and packaging process.

4) Connectors should facilitate the drying process (including hang drying) by loosely binding the socks together so that drying air can flow to all parts of the sock.

Extensive testing by the inventor has uncovered additional criteria for a binding system:

A. The greater the attachment area over which the linking system can be spread on the paired items, the less likely the linking system is to damage the paired items when cleaning cycle or other forces are exerted on the linking system tending to pull the items apart through a connector.

B. The methods of attaching connecting elements to paired cloth items should be impervious to chemicals and temperatures encountered in the washing process for a reasonable user period. If cloth or other material tabs are used as part of a linking system, a method needs to be developed to prevent the tabs from fraying during wear, stress and repeated washing.

C. Systems linking socks together should have short relatively stiff linking systems to prevent the linking system from twisting and tangling around itself or adjacent laundered items.

D. The process of attaching a linking system to socks in the manufacturing environment is greatly simplified and made less expensive if non-cloth connecting components are added after the manufacturing process, either included in packaging or separately purchased and added by the consumer.

E. The attaching mechanisms need to stay with the socks when in use so as to be available whenever the paired items are removed from wear. Users will rarely search for a separate connector when removing socks.

F. Connectors need to be soft, somewhat flexible and have no sharp edges which can snag clothing, etc. during the wearing, washing or storing process.

G. The process for adding a linking system to socks should be done in the sock manufacturing plant and integrated into the process for maximum efficiency.

H. A consumer should be able to eliminate or deactivate a linking system from a pair of purchased socks if so desired without damaging the sock or other paired article.

In the following description, the inventor has noted where the above criteria were used with numbers/letters in brackets.

In his earlier U.S. Pat. No. 5,740,558, the inventor conceived a way to connect paired items together by attaching one end of tabs to each item, then putting connectors on the loose ends. Though this idea functioned well on paired items, the inventor found it difficult to attach tabs with imbedded connectors to socks and other paired items in a production environment. Machines that could spool, cut and position fabric tabs, could not currently handle tape with imbedded connectors such as snaps or thread tape through the closed loop end of some standard connectors. Expensive custom tooling would be necessary for this approach. Therefore, the intent, here, was to create a system that would bind a tab or "handle" to a paired item and allow for a connector to be added—possibly by the consumer—after the tab-attachment process so that manufacture would be easier to accomplish with off-the-shelf equipment.

SUMMARY

It has been discovered that the problems left unanswered by known art can be solved by providing a mechanism for releasably binding paired articles together. The invention consists of short fabric tabs, coated with a film adhesive on one side, adhesively-bonded at both ends to the top (or entry) outside edge of paired cloth items. The inventor has designed a mechanism for releasably binding paired articles together. The invention consists of short fabric tabs, coated with a film adhesive on one side, adhesively-bonded at both ends to the top (or entry) outside edge of paired cloth items.

The preferred orientation of the tabs is for the long side to point vertically down away from the opening or top so as to lay along the elastic ribs rather than across them. (FIG. 1) A flat plastic connector is looped through an unadhered wrinkle in the center of the tabs and then locked into itself to link the items together for storage, washing, etc. When the items are unpaired and in use, the connector is removed from the tab on the second paired item and locked in place around a single tab on the first.

The inventor discovered that if he bound the two ends of a tab to the paired item and left an open loop or wrinkle in the center, he could simplify the attachment process, create a handle for later attachment of a detachable connector, and also create an improved bond to the paired item. (FIG. 1). The improved two-point bond increased the bonding surface area, protected the item from tension on the tab by spreading out the load, prevented pealing of the connection by providing twin anchors to the paired item and had no left-right requirement for the attachable articles.

After testing the placement of the tabs, the inventor found that the best place to attach the handles was the outside edge of the entry area of the sock or paired item. This keeps the attachment away from skin as well as the interface between the wearer and footwear, etc. Further experimentation showed that the best way to attach a small, looped tab to a sock was with the long side of the tab down the outside neck of a sock. This minimized limitations to the stretchability at the entry point of socks and other paired apparel items.

Experimentation showed that the best material to attach to the paired items to create a "handle" would be a cloth fabric, preferably a synthetic because of synthetic's strength, thin profile and low cost. The inventor initially tried stitching narrow, flexible, cloth tabs to the paired items. To minimize costs, he used 1"–2—long tabs cut from off-the-shelf ⅜—to ¼" wide nylon or polyester fabric tape (or ribbon). These materials provided sufficient strength and surface area to bond strongly to socks, etc. and also spread out forces to prevent sock damage from tension on the tab. However, when using short tabs of cloth as a "handle" on the sock, he found that that even after stitching the ends to the sock, there could still be problems with the tab ends fraying and coming loose over time. He began to investigate techniques and materials for coating one side of the tabs with an adhesive material and using the adhesive to eliminate fraying as well as providing the binding process in place of stitching. Adhesives would allow the inventor to bind the full surface of the tab, excluding the loop, to the sock, thus improving load spreading and also eliminate fraying.

Tests with many adhesives showed that most adhesives would not survive repeated washings. However, eventually the inventor found a class of polyurethane (PU) and polyolefin (PO) adhesive films typified by the adhesive film sold by Minnesota Mining and Manufacturing as product "3M 695" film. These films were activated/attached through the application of a combination of heat and pressure. Through experimentation varying testing heat (temperature), time and pressure combinations and using 3–5 mil films, he was able to attach tabs to socks in a fashion which produced a bond that would withstand over 15 pounds of pull and still endure repeated washings with little noticeable deterioration, delamination or fraying. As a further advantage, the coated and adhered tabs stay soft and flexible, do not take on the feel of a hard plastic and do not fray. Another benefit of the film adhesives is that a customer can completely remove the tabs by heating them with an iron.

The double-bond design whereby the two ends of a tab are adhered to a sock with an unadhered center handle was most important in protecting the tab from stress that might peel the tab off the sock. Bonding the tab to cloth paired item entails applying heat to the outward facing side of the tab and driving the adhesive from the inward, coated side of the tab across to the sock. Using thin synthetic tape was critical in achieving fast, thorough heat penetration necessary for a good bond. Polyester and nylon tape have the capability of withstanding attachment temperatures over 300 degrees F. The choice of adhesives worked well because the melt temperatures were in the 250± degrees F. range, well above anything encountered in a washer or dryer. (It may not be high enough to endure the temperatures applied to socks in the "boarding" process, however, which may limit the application point in a sock plant.) The adhesive proved impervious to the washing cycle for a reasonable useful life.

A further benefit of attaching tabs to socks with the heat/pressure sensitive adhesives like 3M 695 was that a consumer could remove or repair/reattach the tabs, if desired, with the aid of an iron generally set to the iron's wool setting—lower if polypropylene used in the sock.

The final step was to determine a way to cut and attach the tabs to socks in a rapid and reliable fashion that would fit into the apparel manufacturing process. After extensive search, the inventor identified an Electro-Seal Mini-Coater machine with which he could coat the tab tape with adhesive film and an Electro-Seal Roll Feed Labeling Machine with which he could cut and heat/pressure attach the coated tape to paired items such as socks. Since more delicate fabrics, like polypropylene, are sensitive to heat, a cycle time of a few seconds is important in avoiding damage to the items during tab attachment.

The fast cycle time is achievable with the adhesives and labeling machines. The machines are also able to seal the tabs with the appropriate unadhered loop in the middle.

During his search for the tab materials and attachment process, the inventor also began to experiment with possible connectors which could be used by the user to link the paired items with looped tabs together. In one embodiment, he chose plastics for its strength, ease of forming and benignness for use on the body. He concentrated on thermoplastics and thermosets such as Polyamides (Nylon), i-ID polyethylene (HOPE) and polypropylene (PP), PP in thicknesses of 20–35 mils being the preferred material for cost, finish and durability.

There are two options for linking the tabs together: 1) to use two connectors, one attached to each item's tab that then can be connected and disconnected to each other, and 2) to use a single connector which remains on one paired item's tab when worn and can be connected to the second when pairing is required. In his notebook, he designed many connectors and found the system would work with a range of connectors from tied strings to key rings. The connector design, which he customized for this application following option 2 above (referred to as the S-link), is shown in FIGS. 2, 3, 4 and 5 with the following characteristics:

1. Stiff wide section makes it easy to thread through the tabs and loops of items to be connected. Easy for user to grasp when threading and unthreading.
2. Loosely holds paired items together to facilitate drying. Facilitates hang drying.
3. Flat, wide structure of shaft holds anchor perpendicular to eyelet after insertion to prevent accidental disengagement and resists exorbitant twisting.
4. Broad head on anchor is designed for easy grasping when connecting and edges prevent accidental disengagement.
5. Key-hole like eyelet keeps anchor from floating in slot in a motion that would increase the chance of accidental disengagement.
6. As a flat plastic part, the punch dies required to make this part are cheap to manufacture and allow many design adjustments for different applications and requirements.
7. Locking mechanism is easy to manipulate by feel (no need to see it), which is helpful for sight-limited users or when used in low light conditions.
8. As a single piece that locks two items with together or compresses an item, it allows the connected items to be manufactured without having to pair right and left.
9. Flexible plastic construction and rounded edges minimize the possibility of abrasions if compressed against the skin of a user when left on the paired item when worn.
10. Easily connected and disconnected from sock so can be eliminated if user does not want to keep connector on one of pair while wearing connected items.
11. Since it is added to the connected items such as socks after manufacture addition of tabs, it simplifies the application of the tabs and reduces sock-tab manufacturing and application costs and complexity.
12. Design (FIG. 3) with hole and slot tends to prevent accidental disengagement and also allows manufacture of slot with looser tolerances in ratio of anchor width to keyhole width.

13. If manufactured with several holes connected by slits, it allows the connector to be used at multiple tightnesses or loop diameters. (FIG. 4)

14. The process for attaching the tabs can be carried out at a number of sites in a sock mill, etc. as well as away from the mill as an after production add on. For socks, appropriate production line locations are:

a. With the label machine attached to the bottom side of a knitting machine, especially on with a toe-closing apparatus, so that as the toe is elevated while stitching, the open cuff could be grasped by the label machine to attach the tab. In this case, adhesive melt points must be high enough to survive the boarding process.

b. Just after the boarding process so that as socks are pulled off the boards, the open ends can be introduced to the label machine for tab attachment.

c. Just after socks are paired for uniform length, each open end can be presented to the label machine for tab attachment.

d. Just prior or just after the socks toes are stitched or possibly during stitching with a mechanism for grabbing the open end as designed for the stitching machines.

With the tabs attached, socks and other connectable items can be packaged for sale in the conventional way with the connector stapled to the packaging, threaded into one of the tabs on a sock or sold in separate packages to consumers.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which:

FIG. 1 shows an example of a pair of socks (56) with the tabs placed vertically down from the opening, parallel to the expansion ribs (55) starting near the top edge (54) of the sock opening. The tabs are attached at either end (51, 52) with a wrinkle (53) in the middle, which is not adhered to the sock. The connector can be threaded through the wrinkles in the process of linking the sock together. The pair of socks (56) are joined by a connector threaded through the wrinkle on each tab and locked with the anchor through the keyhole.

FIG. 2 Shows a side view of the connector seen with the anchor end (I), or male end, locked through the eyelet (H), or slot 46.

FIG. 3 shows the most basic connector that is about 2"–3" long when used with a single pair of socks. The length may be varied, very good results were found using this length. The connector is locked in a loop by twisting the anchor-shaped head (I) 90 degrees along the long part axis and threading it through the eyelet (H), then reversing the rotation of the head 90 degrees so that the ends of the anchor over lap the sides of the hole when forces exert to pull the sides of the loop apart. Dimension B should be greater than dimension A. Dimension D should be greater than dimension C. It is preferred that dimension G should be less than C±2 times F. Thickness ranges from 10 to 40 mils have been found to be satisfactory.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
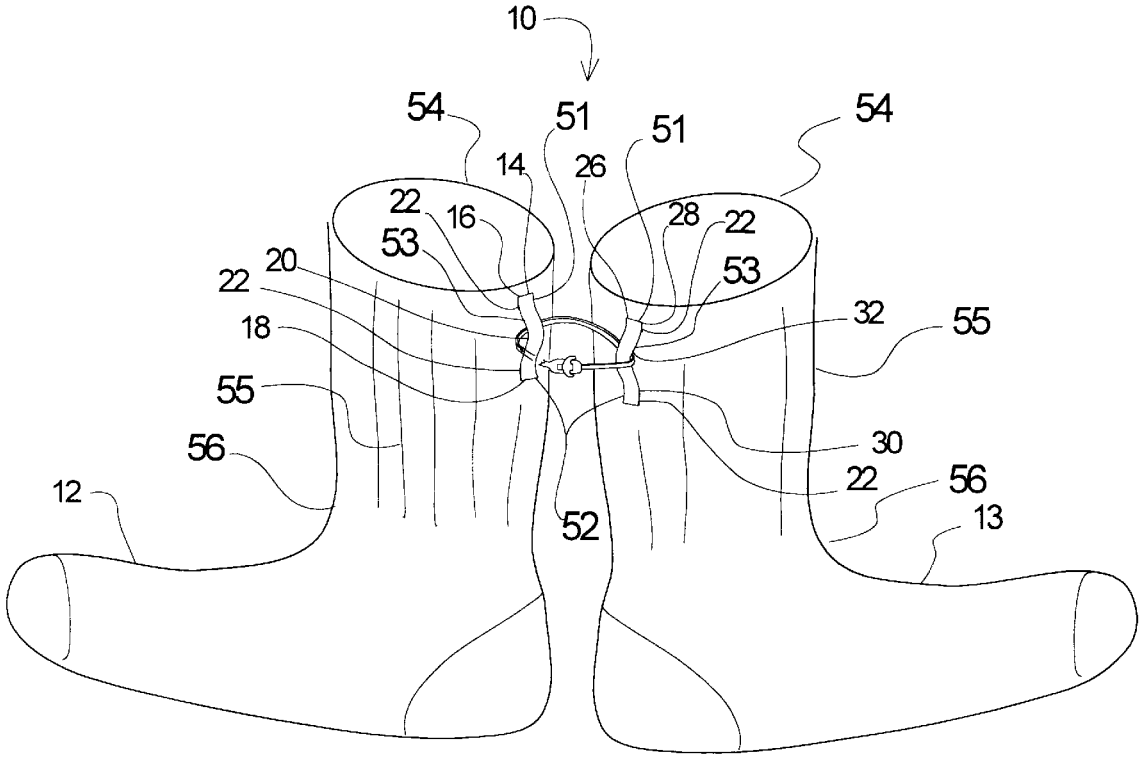

Turning now to FIG. 1 where an example of a pair of socks 56 with the tabs placed vertically down from the opening, parallel to the expansion ribs 55 starting near the top edge 54 of the sock opening. The tabs are attached at either end 51, 52, with a wrinkle or loop 53 in the middle which is not adhered to the sock. The connector can be threaded through the wrinkles in the process of linking the sock together.

Thus, it will be understood that FIG. 1 illustrates a system 10 for attaching and detaching a set of paired items, such as a pair of socks 56, from one another. A preferred example of the invention uses a first item to be paired, such as a first sock 12, and a second item to be paired, such as a second sock 13.

FIG. 1 also illustrates the use of a first tab 14 having a first end 16, a second end 18, and a mid-portion 20. The first end 16 of the first tab and the second end 18 of the first tab will preferably be attached to the first item to be paired through an adhesive 22, such as the adhesives discussed above. The mid-portion 20 of the first tab 14 will be detached from the first item to be paired, or sock 12, in order to form a first loop 24.

A second tab 26 having a first end 28, a second end 30, and a mid-portion 32. The first end 28 of the second tab 26 and the second end 30 of the second tab 26 is attached to the second item to be paired by an adhesive 22. The mid-portion 32 of the second tab 26 being detached from the second item, or sock 13 to be paired in order to form a second loop 34.

As illustrated in FIGS. 1–5, a re-useable elongated, generally flat connector 36 having a male end 38 or portion and a female end 40. The male end 38 includes a broadened section 42 of a width 45, the female 40 end includes a slotted aperture 46 of a length 48 dimension and a width 44 dimension. The length 48 dimension is preferably longer than the width 44 dimension. The length 48 dimension of the slotted aperture 46 will preferably generally extend towards the male portion or male end 38. Additionally, the length dimension 48 should be larger than the width 45 of the broadened section 42. The first item will be attached to the second item by passing the elongated, generally flat connector 36 through the first loop 24 and the second loop 34 and then inserting the male end 38 through the female end 40 to lock the re-useable elongated generally flat connector 36 through the first loop 24 and the second loop 34.

Figure 2:
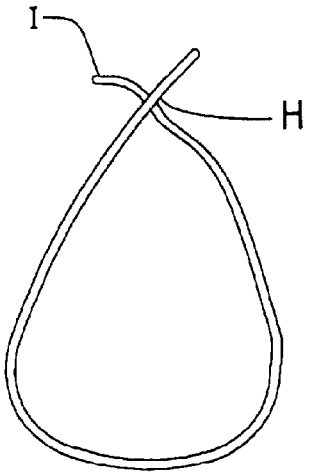

FIG. 2 Shows a side view of the connector seen with the anchor end (I) locked through the eyelet (H). The anchor end (I) includes the male end 38, and the eyelet (H) includes the female end 40.

Figure 3:
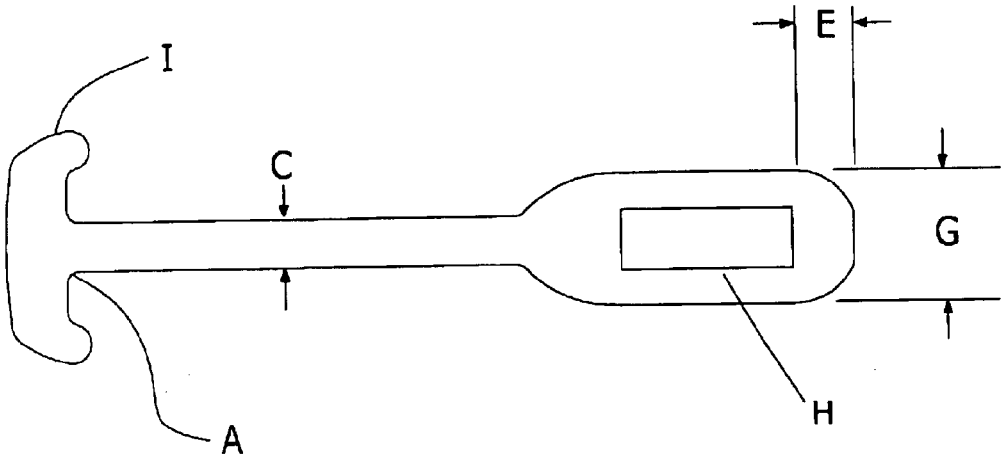

FIG. 3 shows an example of the most basic connector that is preferably about 2 inches to 3 inches long. The length may be varied, but very good results were found using this length. The connector is locked in a loop by twisting the anchor-shaped head (I), or male end 38, 90 degrees along the long part axis and threading it through the eyelet (H), or female end 40. Then reversing the rotation of the male end 38 by 90 degrees, so that the ends of the anchor over lap the sides of the hole when forces exert to pull the sides of the loop apart. The rotation of the male end 38 can reverse by action of the resiliency of the material of the connector 36.

As illustrated in FIG. 2, dimension "B", which is the length 48 of the aperture 46 in the female end 40 should be greater than dimension "A", which is the width 45 of the broadened section 42 of the male end 38. Dimension "D", which is the width of the aperture 46, should be greater than dimension "C", which is the width of the body of the connector 36. It is preferred that dimension "G", the width of the head of the female end 40, should be less than "C"±2 times "F", where "F" is the width of a recess in the male end 38 illustrated in FIG. 2. The thickness of the connector 36 may be from 10 to 40 mils, and may be of uniform thickness.

Figure 4:
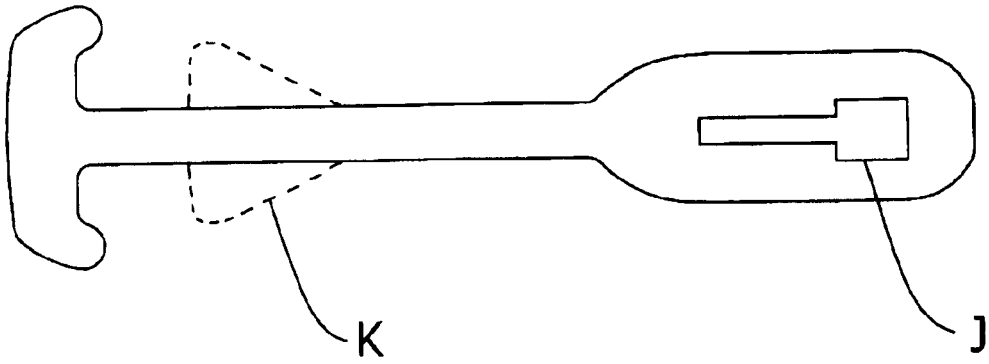
FIG. 4 shows a connector design with a keyhole slot (J) that is designed to reduce the possibility of the connector disconnecting accidentally. A single or double barb (K) may be placed on the shaft to limit the movement of the shaft when connected as a way to further reduce the possibility of accidental disconnection.

FIG. 4 shows a connector design with a keyhole slot (J), or slotted aperture 46, that is designed to reduce the possibility of the connector disconnecting accidentally. A single or double barb (K) may be placed on the shaft to limit the movement of the shaft when connected as a way to further reduce the possibility of accidental disconnection.

Figure 5:
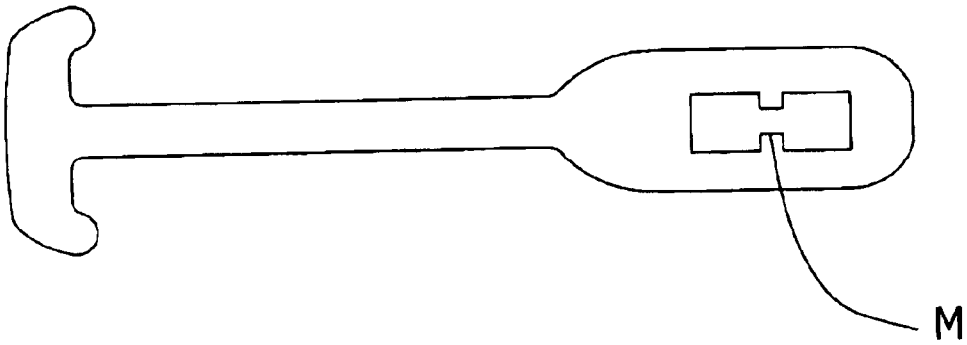
FIG. 5 shows a connector design with a notch or notches (N) in the slot which will allow the closure to be locked into two different size loops, one slightly smaller that the other.

FIG. 5 shows a connector design with a notch or notches (M) in the slotted aperture 46, which will allow the closure to be locked into two different size loops, one slightly smaller that the other.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A system for attaching together and detaching a set of paired items, comprising:

a first item to be paired;

a second item to be paired;

a first tab of a fabric material, the first tab having a first end of the first tab, a second end of the first tab and a mid-portion of the first tab, the first end of the first tab and the second end of the first tab being attached to the first item to be paired by an adhesive that has penetrated the fabric of the tab, and the mid-portion of the first tab being detached from the first item to be paired in order to form a first loop;

a second tab of a woven material, the second tab having a first end of the second tab, a second end of the second tab, and a mid-portion of the first tab, the first end of the second tab and the second end of the second tab being attached to the second item to be paired by an adhesive that has penetrated the fabric of the tab, and the mid-portion of the second tab being detached from the second item to be paired in order to form a second loop; and a re-useable elongated, generally flat connector having a male end and a female end, the male end including a broadened section of a width, the female end including a slotted aperture of a length dimension and a width dimension, the length dimension being longer than the width dimension, the slotted aperture having the length dimension generally extending towards the male end, the length dimension being larger than the width of the broadened section, so that the first item is attached to the second item by passing the elongated, generally flat connector through the first loop and the second loop and then inserting the male end through the female end to lock the re-useable elongated generally flat connector through the first loop and the second loop.

2. A system according to claim 1 wherein the first end of the first tab and the second end of the first tab attached to the first item to be paired are generally planar and are adhered in a generally parallel fashion relative to one another against the first item to be paired.

3. A system according to claim 1 wherein the first end of the second tab and the second en of the second tab attached to the second item to be paired are generally planar and are adhered in a generally parallel fashion relative to one another against the First item to be paired.

4. A system according to claim 1 wherein the first end of the first tab and the second end of the first tab being attached to the first item to be paired are generally planar and are adhered in a spaced apart fashion relative go one another against the first item to be paired.

5. A system according to claim 1 wherein the first end of the second tab and the second end of the second tab being attached to the first item to be paired are generally planar and are adhered in a spaced apart fashion relative to one another against the second item to be paired.

6. A system according to claim 1 wherein the slotted aperture of said connector is generally oval.

7. A system for attaching together and detaching a pair of socks, comprising:

a first sock, the first sock having an opening adapted for accepting a person's foot;

a second sock, the second sock having an opening adapted for accepting a person's foot;

a first tab of a fabric material, the first tab having a first end of the first tab, a second end of the first tab and a mid-portion of the first tab, the first end of the first tab and the second end of the first tab being attached to the first sock by an adhesive that has penetrated the fabric of the tab and the first sock, and the mid-portion of the first tab being detached from the first sock in order to form a first loop;

a second tab of a fabric material, the second tab having a first end of the second tab, a second end of the second tab, and a mid-portion of the first tab, the first end of the second tab and the second end of the second tab being attached to the second sock by an adhesive that has penetrated the fabric of the tab and the second sock, and the mid-portion of the second tab being detached from the second sock in order to form a second loop; and a re-useable elongated, generally flat connector having a male end and a female end, the male end including a broadened section of a width, the female end including a slotted aperture of a length dimension and a width dimension, the length dimension being longer than the width dimension, the slotted aperture having the length dimension generally extending towards the male end, the length dimension being larger than the width of the broadened section, so that the first sock is attached to the second sock by passing the elongated, generally flat connector through the first loop and the second loop and then inserting the male end through the female end to lock the re-useable elongated generally flat connector through the first loop and the second loop.

8. A system according to claim 7 wherein the first end of the first tab and the second end of the first tab attached to the first sock to be paired are generally planar and are adhered in a generally parallel fashion relative to one another against the first sock to be paired.

9. A system according to claim 7 wherein the first end of the second tab and the second end of the second tab attached to the second sock to be paired are generally planar and are adhered in a generally parallel fashion relative to one another against the first sock to be paired.

10. A system according to claim 7 wherein the first end of the first tab and the second end of the first tab being attached to the first sock to be paired are generally planar and are adhered in a spaced apart fashion relative to one another against the first sock to be paired.

11. A system according to claim 7 wherein the first end of the second tab and the second end of the second tab being attached to the first sock to be paired are generally planar and are adhered in a spaced apart fashion relative to one another against the second sock to be paired.

12. A system according to claim 7 wherein the slotted aperture of said connector is generally oval.

13. A method for attaching and detaching a pair of socks to one another, comprising:

providing a first sock, the first sock having an opening adapted for accepting a person's foot;

providing a second sock, the second sock having an opening providing adapted for accepting a person's foot;

providing a first tab of a fabric material, the first tab having a first end of the first tab, the first end of the first tab having a thermoplastic adhesive that has penetrated the fabric, the first tab further having a second end of the first tab and a mid-portion of the first tab, attaching the first end of the first tab by melting the thermoplastic adhesive while pressing the first end of the first tab against the first sock to allow the thermoplastic adhesive to melt and penetrate both the first end of the second tab and the second sock, and attaching the second end of the first tab to the first sock, while leaving the mid-portion of the first tab detached from the first sock in order to form a first loop;

providing a second tab of a fabric material, the second tab having a first end of the second tab, the first end of the second tab having a thermoplastic adhesive that has penetrated the fabric of the second tab, the second tab further having a second end of the second tab, and a mid-portion of the first tab, attaching the first end of the second tab by melting the thermoplastic adhesive while pressing a the first end of the second tab against the first sock, to allow the thermoplastic adhesive to melt and penetrate both the first end of the second tab and the second sock and attaching the second end of the second tab to the second sock, and while leaving the mid-portion of the second tab being detached from the second sock in order to form a second loop; and providing a re-useable elongated, generally flat connector having a male end and a female end, the male end including a broadened section of a width, the female end including a slotted aperture of a length dimension and a width dimension, the length dimension being longer than the width dimension, the slotted aperture having the length dimension generally extending towards the male end, the length dimension being larger than the width of the broadened section, so that the first sock is attached to the second sock by passing the elongated, generally flat connector through the first loop and the second loop and then inserting the male end through the female end to lock the re-useable elongated generally flat connector through the first loop and the second loop.

14. A method according to claim 13 wherein the first end of the first tab and the second end of the first tab attached to the first sock to be paired are generally planar and are adhered in a generally parallel fashion relative to one another against the first sock to be paired.

15. A method according to claim 13 wherein the first end of the second tab and the second end of the second tab attached to the second sock to be paired are generally planar and are adhered in a generally parallel fashion relative to one another against the first sock to be paired.

16. A method according to claim 13 wherein the first end of the first tab and the second end of the first tab being attached to the first sock to be paired are generally planar and are adhered in a spaced apart fashion relative to one another against the first sock to be paired.

17. A method according to claim 13 wherein the first end of the second tab and the second end of the second tab being attached to the first sock to be paired are generally planar and are adhered in a spaced apart fashion relative to one another against the second sock to be paired.

18. A method according to claim 13 wherein the slotted aperture of said connector is generally oval.

* * * * *